US009989889B2

(12) United States Patent
Sato

(10) Patent No.: US 9,989,889 B2
(45) Date of Patent: Jun. 5, 2018

(54) TONER CONTAINER

(71) Applicants: KABUSHIKI KAISHA TOSHIBA, Tokyo (JP); TOSHIBA TEC KABUSHIKI KAISHA, Tokyo (JP)

(72) Inventor: Tsutomu Sato, Shizuoka (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 15/498,858

(22) Filed: Apr. 27, 2017

(65) Prior Publication Data

US 2017/0227888 A1 Aug. 10, 2017

Related U.S. Application Data

(63) Continuation of application No. 14/921,206, filed on Oct. 23, 2015, now Pat. No. 9,665,039, which is a continuation of application No. 14/010,884, filed on Aug. 27, 2013, now Pat. No. 9,201,344, which is a continuation-in-part of application No. 13/893,394, filed on May 14, 2013, now Pat. No. 9,063,458.

(30) Foreign Application Priority Data

May 20, 2012 (CN) ..... 2012 2 0228348 U

(51) Int. Cl.
*G03G 15/00* (2006.01)
*G03G 15/08* (2006.01)

(52) U.S. Cl.
CPC ..... *G03G 15/0865* (2013.01); *G03G 15/0877* (2013.01)

(58) Field of Classification Search
CPC ..... G03G 15/0875; G03G 15/0886; G03G 15/0865; G03G 2215/0692
See application file for complete search history.

(56) References Cited

U.S. PATENT DOCUMENTS

| | | | |
|---|---|---|---|
| 6,014,536 | A | 1/2000 | Ban et al. |
| 6,128,453 | A | 10/2000 | Ban et al. |
| 6,584,293 | B1 | 6/2003 | Wang et al. |
| 6,628,914 | B1 | 9/2003 | Wang et al. |
| 7,734,197 | B2 | 6/2010 | Sato |
| 7,962,072 | B2 | 6/2011 | Li |
| 9,063,458 | B2 | 6/2015 | Sato |
| 9,201,344 | B2 | 12/2015 | Sato |
| 2003/0215261 | A1 | 11/2003 | Karakama et al. |

(Continued)

OTHER PUBLICATIONS

Non-Final Office Action for U.S. Appl. No. 13/893,394 dated Oct. 6, 2014, 18 pages.

(Continued)

*Primary Examiner* — Walter Lindsay, Jr.
*Assistant Examiner* — Jessica L Eley
(74) *Attorney, Agent, or Firm* — Patterson & Sheridan, LLP

(57) ABSTRACT

In one embodiment, a toner container comprises a toner container body in which toner is stored, a cover portion configured to cover the toner container body, and a projection. The projection is provided in the vicinity of a rear end portion in a longitudinal direction of the cover portion or a longitudinal direction of the toner container body, and projecting toward a rear side of the toner container.

15 Claims, 13 Drawing Sheets

(56) References Cited

U.S. PATENT DOCUMENTS

| | | | | |
|---|---|---|---|---|
| 2006/0013621 | A1 | 1/2006 | Kimura et al. | |
| 2007/0269225 | A1 | 11/2007 | Sato | |
| 2007/0269227 | A1* | 11/2007 | Sato | G03G 21/1676 399/13 |
| 2007/0269237 | A1* | 11/2007 | Sato | G03G 15/0875 399/260 |
| 2010/0166466 | A1 | 7/2010 | Sato | |
| 2011/0123229 | A1 | 5/2011 | Takashima et al. | |
| 2012/0014713 | A1 | 1/2012 | Murakami et al. | |
| 2013/0308986 | A1 | 11/2013 | Sato | |

OTHER PUBLICATIONS

Non-Final Office Action for U.S. Appl. No. 14/010,884 dated Jan. 2, 2015, 22 pages.

"Designing with Plastics", ISBN 3-446-225950-0, Gunter Erhard, Jan. 2006, p. 311.

* cited by examiner

TONER CONTAINER

CROSS-REFERENCE TO RELATED APPLICATIONS

This is a continuation of application Ser. No. 14/921,206, filed on Oct. 23, 2015, which is a continuation of application Ser. No. 14/010,884, filed on Aug. 27, 2013, now U.S. Pat No. 9,201,344, granted on Dec. 1, 2015, which was a continuation-in-part of application Ser. No. 13/893,394, filed on May 14, 2013, now U.S. Pat. No. 9,063,458, granted on Jun. 23, 2015, which claims the benefit of priority from prior Chinese Patent Application No. 201220228348.2, filed May 20, 2012. The entire contents of the foregoing applications are incorporated herein by reference.

FIELD

The embodiments of the present invention relate to a toner container.

BACKGROUND

An image forming device always has a toner cartridge for supplying a toner to a developing device. The toner cartridge is detachably mounted on the image forming device, and when the toner in the toner cartridge is used up, the user can replace it by himself. In order to prevent a toner container from not being mounted at the right position in the image forming device (i.e., the so-called half-inserted state), an engagement mechanism is provided on the side of the body of the image forming device, for the engagement of the toner cartridge. However, the above mentioned mechanism for preventing half-insertion of the toner container has a defect that, the engagement mechanism must be released one by one when it is necessary to remove the toner cartridge from the body of the image forming device.

DESCRIPTION OF THE DRAWINGS

The drawings of the present embodiment of the invention are incorporated into the Description and constitute a portion of the Description. These drawings illustrate the embodiments of the present embodiment of the invention and explain the principle of the present embodiment of the invention together with the above general description and the following detailed description on the embodiments.

DETAILED DESCRIPTION

Figure 1:
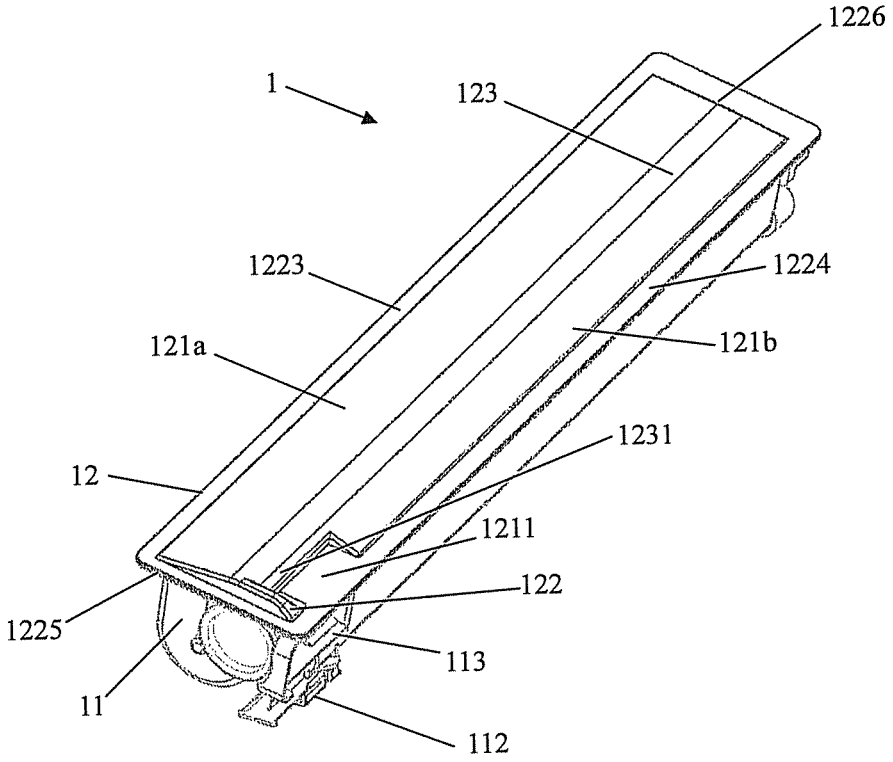
FIG. 1 is a stereogram of the toner cartridge according to the first embodiment.

In order to solve the above problem, the inventor of the present invention is dedicated to research and proposes the following solution.

According to the first aspect of the present embodiment, there is provided a toner container, characterized by comprising: a toner container body having a toner chamber for housing a toner inside and a toner discharge port provided at one end of the toner container body; and a cover portion covering the toner container body, wherein a projection is provided at one end of a top surface of the cover portion in a longitudinal direction, and a surface of the projection facing the other end in the longitudinal direction is an inclined portion.

Based on this, the projection is provided on a portion of the toner container, and when the toner container is mounted at the right position, a contact provided on the side of the body of the image forming device is moved to the right position, such that a cover of the image forming device covering the toner container can be closed to prevent the half-inserted state of the toner container.

According to the second aspect of the present embodiment, the toner container according to the first aspect of the present embodiment is characterized in that, the inclined portion is an inclined plane, or a curved surface having a gradually increased or reduced slope.

The surface of the projection facing the other end in the longitudinal direction is an inclined plane, or a curved surface having a gradually increased or reduced slope. Based on this, the contact can smoothly slide onto the flat portion of the projection to the right position, so that the cover of the image forming device can be closed. During the process in which the contact is in contact with the projection, the contact slides in such a manner that it gradually gets close to the flat surface of the projection (i.e., the contact slides from the bottom up).

According to the third aspect of the present embodiment, the toner container according to the first aspect of the present embodiment is characterized in that, the maximum height of the projection is 6 mm-10 mm.

Based on this, if the maximum height of the projection is within the above range, the projection can sufficiently lift the contact, thereby making the height of the contact as small as possible to save space in the toner container for housing a toner, while enabling the contact to correctly cooperate with the cover portion of the image forming device so as to accomplish the function of detecting half-inserted state.

According to the fourth aspect of the present embodiment, the toner container according to the first aspect of the present embodiment is characterized in that, a flat portion is provided on an upper surface of the projection, and a width of the flat portion in the longitudinal direction is 0.5 mm-10 mm.

Based on this, if the width of the flat portion in the longitudinal direction is within the above range, when the flat portion is in contact with the contact, it can maintain a sufficient contact area with the contact so as to sufficiently lift the contact, and at the same time, can prevent the case where the contact is lifted before the toner container sufficiently enters the body of the image forming device (before it reaches the right position). Thus, it is possible to more accurately detect the half-inserted state of the toner container.

According to the fifth aspect of the present embodiment, the toner container according to the first aspect of the present embodiment is characterized in that, the maximum height of the projection is 7 mm-9 mm, and a flat portion is provided on an upper surface of the projection, the width of the flat portion in the longitudinal direction is 2.5 mm-5 mm.

Based on this, when the maximum height of the projection is 7 mm-9 mm and the width of the flat portion in the longitudinal direction is 2.5 mm-5 mm, it is possible to save space in the toner container for housing a toner, while giving full play to the function of detecting half-inserted state based on the lifting of the contact.

According to the sixth aspect of the present embodiment, the toner container according to the first aspect of the present embodiment is characterized in that, a first rib and a second rib extending in the longitudinal direction are provided on the left and right sides of the cover portion, respectively, the top surface comprises: a first inclined surface extending in the longitudinal direction and inclined in such a manner that it rises from the first rib to the vicinity of the center of the top surface in the width direction; and a second inclined surface extending in the longitudinal direction and inclined in such a manner that it rises from the second rib to the vicinity of the center of the top surface in the width direction.

Based on this, at the time of inserting the toner container into the image forming device, with the guide of the rib, the toner container can enter the image forming device more smoothly. When the toner container has already been inserted into the image forming device, the plane defined by the first rib and the second rib inclines, which thereby can make the space for housing a toner cartridge compact, thus achieving miniaturization of the device.

According to the seventh aspect of the present embodiment, the toner container according to the sixth aspect of the present embodiment is characterized in that, the toner discharge port is in parallel with the first inclined surface.

This fully ensures that the toner is discharged smoothly, while making the space of the toner cartridge compact to achieve miniaturization of the device.

According to the eighth aspect of the present embodiment, the toner container according to the sixth aspect of the present embodiment is characterized in that, the first inclined surface has an inclination angle of 5°-30°.

Based on this, the toner container is loaded into the image forming device in such a manner that the first rib is elevated and the second rib is lowered. In addition, the top surface is a flat surface, which makes the mounting of the tags etc. of the toner container easier. According to the ninth aspect of the present embodiment, the toner container according to the sixth aspect of the present embodiment is characterized in that, a concave portion is formed on a side surface of the toner container body provided on the side of the second inclined surface.

Based on this, the user can put his hands on the concave portion, to mount/dismount the toner cartridge, which facilitates the user's operation.

According to the tenth aspect of the present embodiment, the toner container according to the ninth aspect of the present embodiment is characterized in that, a cutout portion is formed at a position of the second inclined surface corresponding to the concave portion.

Based on this, a protruding shape is formed in the handle position, which therefore can prevent the toner from entering and remaining in the region.

Hereinafter, the embodiment is described with reference to the drawings. In addition, in the following description, when the same reference sings are used, the same reference signs mean having the same configuration and function.

When the user inserts and mounts the toner cartridge 1 at the specified position of the body of the image forming device 200 etc., the side near the user is the front side, the side far away from the user is the rear side, and at this time, the left hand side of the user is the left side, the right hand side of the user is the right side, and description is thereby made. It is the same case with the toner cartridge.

The First Embodiment

FIG. 1 is a stereogram view of the toner container according to the first embodiment. As shown in FIG. 1, the toner cartridge 1, as the toner container, comprises: a toner cartridge body 11 housing a toner and a toner discharge port 112 provided at one end of the toner container cartridge 11; and a cover portion 12 covering the toner cartridge body 11. The toner cartridge supplies a toner to a developing device (not shown) via the toner discharge port 112 provided on the toner cartridge body 11.

Figure 2:
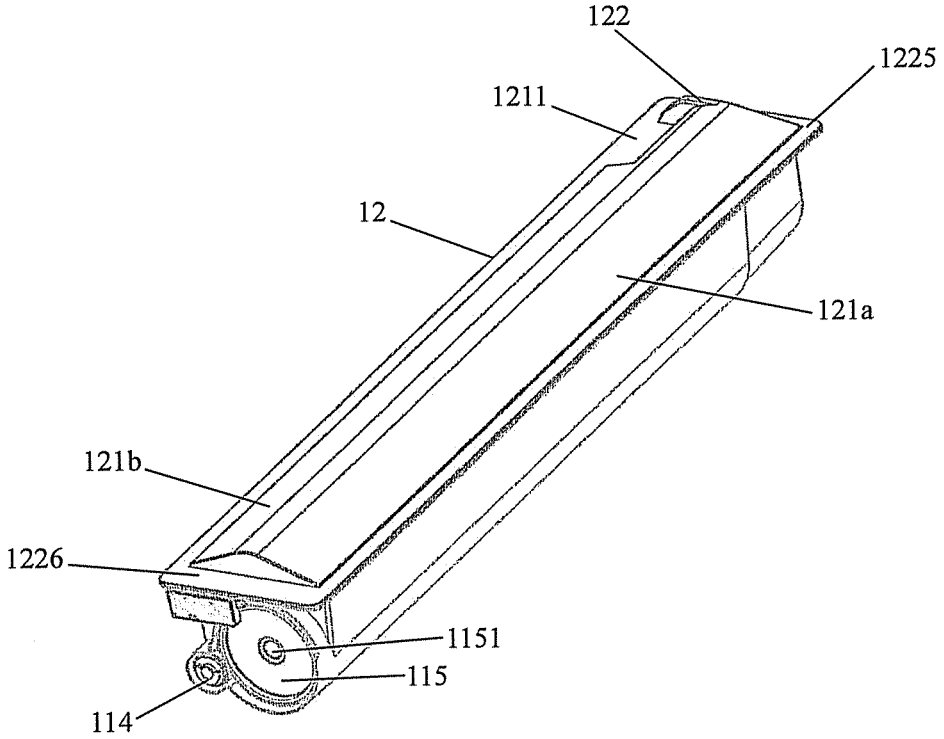
FIG. 2 is a stereogram of the toner cartridge according to the above embodiment.
Figure 3B:
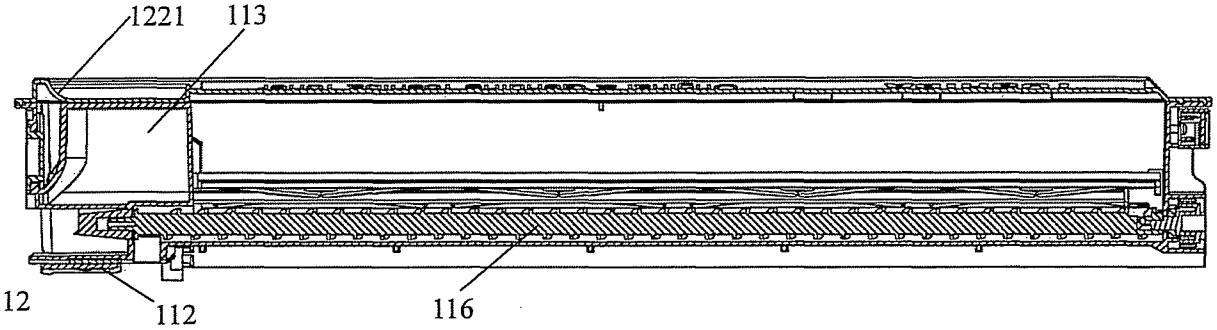
FIG. 3B is a sectional view along the line A-A' in FIG. 3A.
Figure 3A:
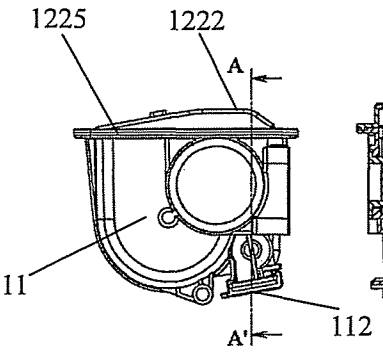
FIG. 3A is a front view of the toner cartridge according to the above embodiment as viewed from the front side.

FIG. 2 is a diagram of the toner cartridge 1 viewed from the rear side. FIG. 3A is a front view of the toner cartridge according to the present embodiment as viewed from the front side, and FIG. 3B is a sectional view along the line A-A' in FIG. 3A. As shown in FIGS. 2 and 3, at the rear side of the toner cartridge 1, there are provided a coupling gear 114 driven by a motor (not shown) and a stirring gear 115 (driving means) connected to the coupling gear 114. In the interior of the toner cartridge 1, there are provided an auger 116 conveying a toner to the toner discharge port 112, and a stirrer stirring the toner. A concave portion 1151 is formed in the central portion of the stirring gear 115, and the direction in which the stirrer inside the toner cartridge 1 shall rotate is indicated by engraving on the surface of the stirring gear 115.

The coupling gear 114 is in connection with the auger 116, such that the stirring gear 115 is rotated when the auger 116 is made to rotate. The stirring gear 115 makes the stirrer (not shown) rotating. In the vicinity of the stirring gear 115 of the toner cartridge 1, there is provided an IC chip recording data such as the number of the toner cartridges used.

As shown in FIG. 1, a first rib 1223 and a second rib 1224 extending in the longitudinal direction are provided on the left and right sides of the cover portion 12, respectively. At the time of slidably inserting the toner cartridge 1 into the image forming device 200, the first rib 1223 and the second rib 1224 serve as guide tracks. According to needs, it is also feasible to arrange a front rib 1225 and a rear rib 1226 extending in the width direction at the front and rear sides of the cover portion 12, respectively. A first inclined surface 121*a* and a second inclined surface 121*b* which are not in bilateral symmetry and which are connected with the ribs are provided on the top surface, wherein the first inclined surface 121*a* extends in the front-rear direction (i.e. the longitudinal direction) of the toner cartridge 1 and is inclined in such a manner that it rises from the first rib 1223 to the central portion 123 (located in the vicinity of the center) of the top surface 121 in the width direction, and the second inclined surface 121*b* extends in the front-rear direction (i.e. the longitudinal direction) of the toner cartridge 1 and is inclined in such a manner that it rises from the second rib 1224 to the central portion 123 (located in the vicinity of the center) of the top surface 121 in the width direction. Preferably, the first inclined surface 121*a* and the second inclined surface 121*b* are configured as smooth planes. The first rib 1223 and the second rib 1224 are respectively combined with the ribs (not shown) of the body of the toner container in a face-to-face manner, to form the horizontal bottom surface of the cover portion 12.

Preferably, the left inclined surface 121*a* has an inclination angle of 5°-30°, wherein the inclination angle refers to the angle between the first inclined surface 121*a* and the front rib 1225.

A projection 122 is provided at one end of the top surface 121 of the cover portion 12 in the front-rear direction, and a surface of the projection 122 facing the other end in the front-rear direction is an inclined portion 1221. The height of the inclined portion 1221 declines towards rear rib 1226 along the longitudinal direction. As shown in FIG. 1, the projection 122 in the shape of a convex portion is provided between the front rib 1225, and the first inclined surface 121*a* and the second inclined surface 121*b*, the projection 122 is in connection with the first inclined surface 121*a* and the second inclined surface 121*b*, and is provided in the direction perpendicular to the cover portion 12.

As shown in FIG. 3, the inclined portion 1221 is an inclined plane, or a curved surface having a gradually increased or reduced slope. The maximum height of the projection 122 is 6 mm-10 mm, preferably 7 mm-9 mm, more preferably 8 mm. The so-called maximum height of the projection refers to the distance from the projection to the front rib 1225 in the front view in FIG. 3A. On the upper surface of the projection 122, there is provided a flat portion 1222, and the width of the flat portion 1222 in the longitudinal direction is 0.5 mm-10 mm, preferably 2.5 mm-5 mm, more preferably 3 mm. The purpose of setting the width of the flat portion 1222 on the upper surface of the projection 122 within the above range is to prevent the case where, if the width is too great, when it is required to take the toner cartridge 1, the contact 201 cannot fall from the flat portion 1222 immediately, and the contact 201 in front of the right position is still up (stay on height). From this viewpoint, it is preferable that there exists a position closely behind the flat portion 1222, whose height is smaller than the flat portion 1222.

That is, the rear portion of the projection of the cover portion 12 forms, via the inclined portion 1221, the stepped portion 1231 in connection with the projection 122. The surface of the inclined portion 1221 is a continuous surface connecting the projection 122 and the stepped portion 1231. The stepped portion 1231 is located at a position higher than the bottom surface of the cover portion 12, but slightly lower than the top surface of the projection 122. With such configuration, when the contact 201 is at the right position, the contact 201 can smoothly rise to the top surface of the projection 122. In the case where the inclined portion 1221 is not set, but a stepped portion 1231 perpendicular to the bottom surface of the cover portion is set on the back of the projection 122, at the time of mounting the toner container 1 in the image forming device 200, in order enable the contact 201 to rise to the top surface of the projection, it is necessary to reduce the height difference between the top surface of the projection and the top surface of the stepped portion.

The stepped portion 1231 preferably extends to the rear end portion of the cover portion 12 in the extending direction of the toner container 1. In addition, the stepped portion 1231 can have the same height, and can also be inclined from the front side to the rear side.

Figure 4A:
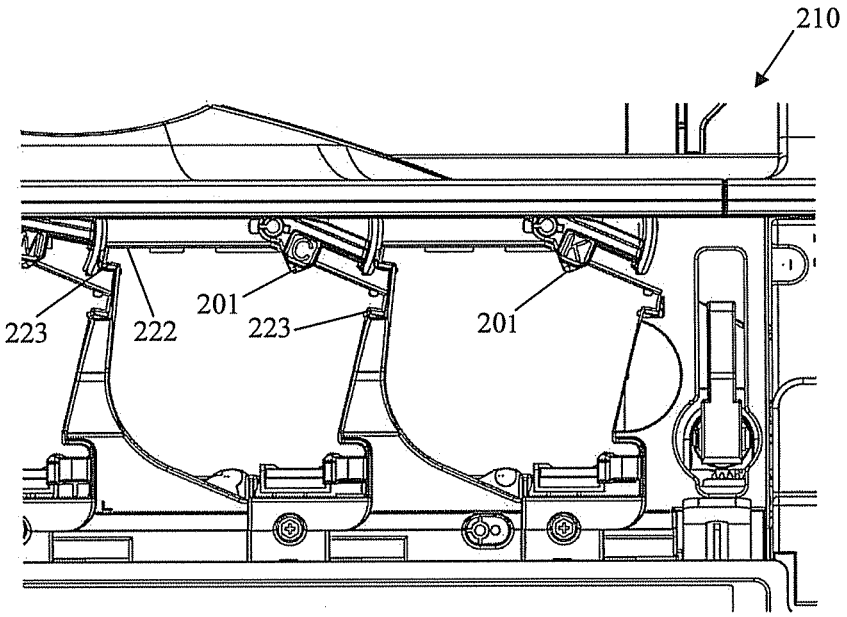
FIG. 4A is a front view of the body 210 of the image forming device in the state in which the toner cartridge 1 is not mounted.
Figure 4B:
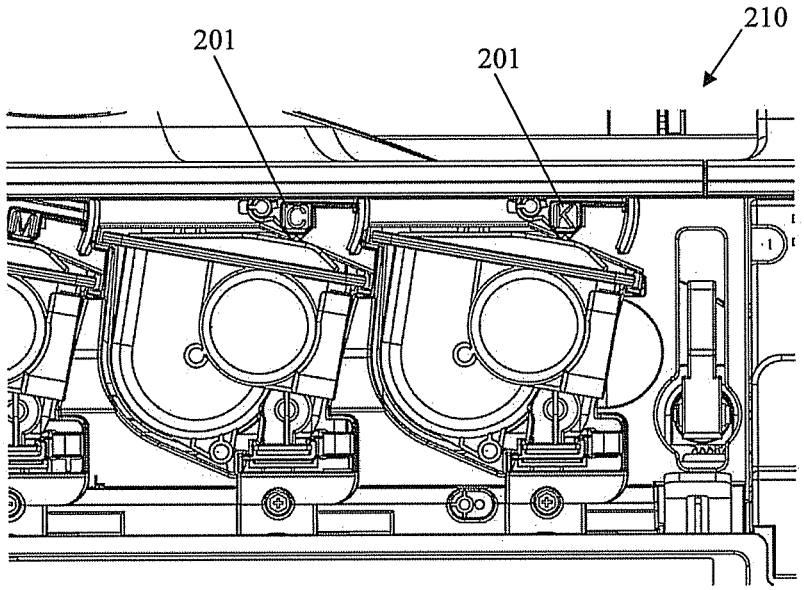
FIG. 4B is a front view of the body 210 of the image forming device when the toner cartridge 1 is mounted at the right position.

FIG. 4A is a front view of the body 210 of the image forming device in the state in which the toner cartridge 1 is not mounted, and FIG. 4B is a front view of the body 210 of the image forming device when the toner cartridge 1 is mounted at the right position. As shown in FIG. 4, on the side of the image forming device 200, at a position facing the projection 122, there are provided a plurality of contacts 201 which are supported rotatably. Each contact 201 is labeled with any one of the YMCK, so as to make it easy to judge the position where the toner cartridge 1 shall be mounted at the time of mounting the YMCK toner cartridges 1.

As shown in FIG. 4A, when the toner cartridge 1 is not within the body 210 of the image forming device, the contact 201 is in a falling state, at the lower position. At the time of mounting the toner cartridge 1 to the image forming device 200, the contact 201 is extruded by the projection 122 of the toner cartridge 1, and thereby, rotates. By inserting the toner cartridge 1, as shown in FIG. 4B, the contact 201 is pushed up by the projection 122.

Figure 5:
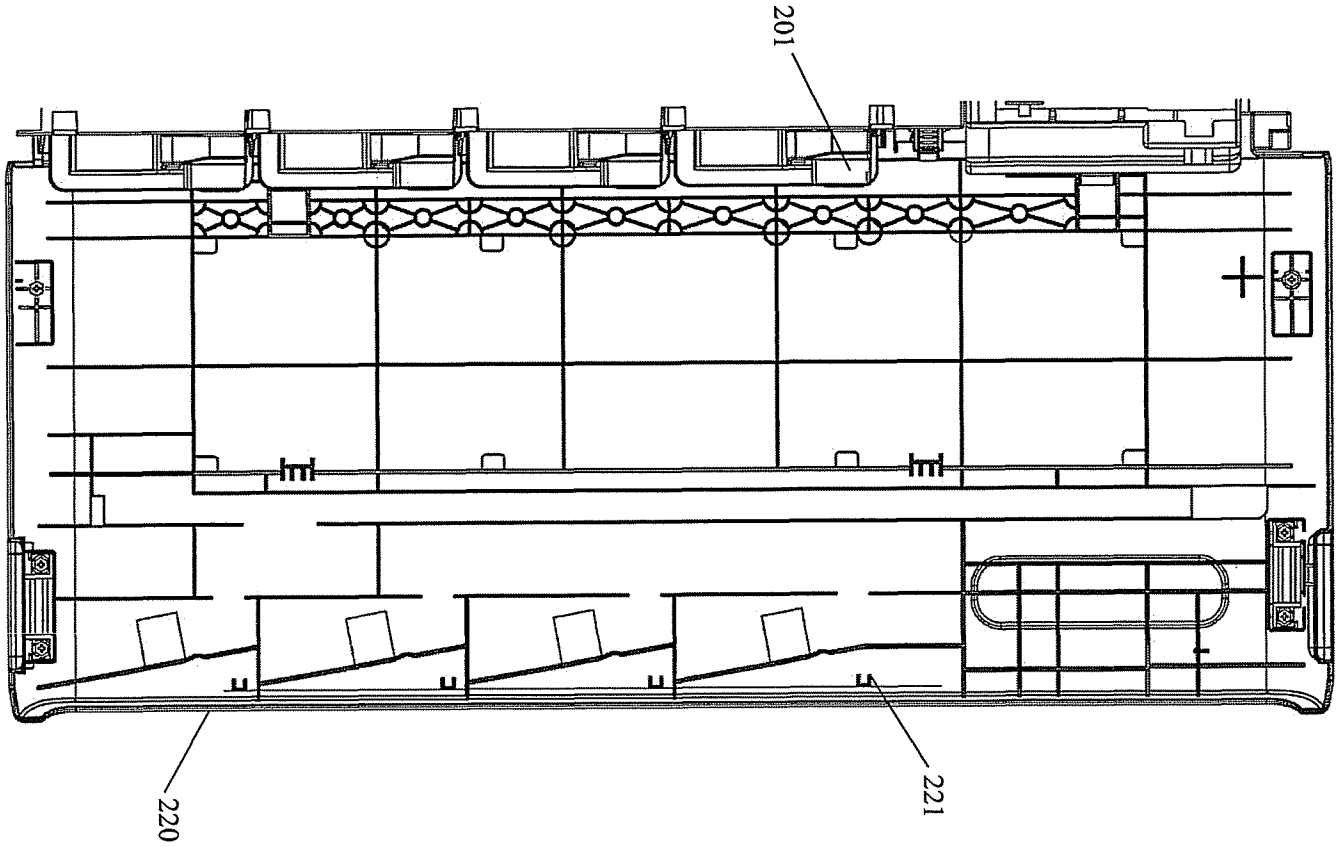
FIG. 5 is a top view in the state in which the front cover is opened.
Figure 6A:
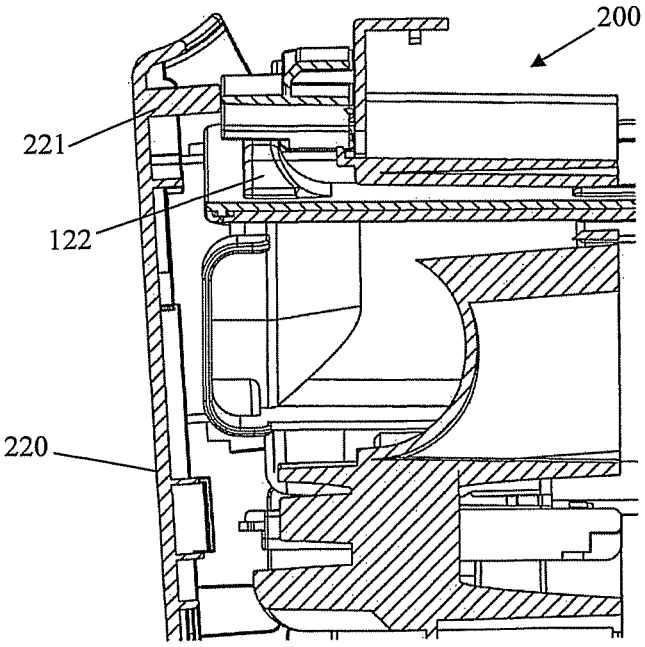
FIG. 6A is a sectional view of the toner container in half-inserted state.
Figure 6B:
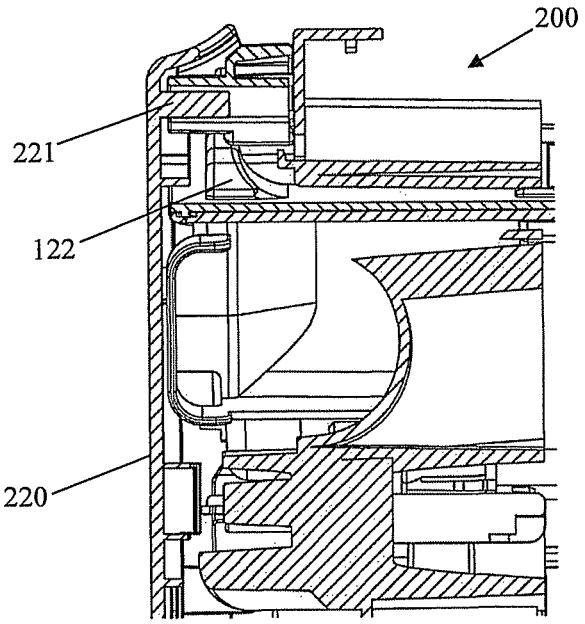
FIG. 6B is a sectional view when the front cover is closed in the state of FIG. 4B.

FIG. 5 is a top view in the state in which the front cover is opened. FIG. 6A is a sectional view of the toner container in half-inserted state, and FIG. 6B is a sectional view when the front cover is closed in the state of FIG. 4B.

As shown in FIG. 5, on the inner side of the front cover 220 of the image forming device 200, there is also provided a cover side projection 221. As shown in FIG. 6A, if the contact 201 does not fully rise to the specified position, the contact abuts against the projection 221 of the front cover to interfere with the front cover 220, and thus, the front cover 220 is not closed. In other words, if the toner cartridge 1 is not inserted to a depth (inside) and is not mounted in the right position, the contact 201 is not elevated completely, and thus, the front cover is not closed. On the contrary, as shown in FIG. 6B, the contact 201 is extruded by the projection 122 of the toner cartridge 1, and is hold up to the right position, the front cover projection 221 goes into underside of the contact 201, then the contact 201 does not interfere with the closing of the front cover 220, and the front cover 220 can be closed normally.

With this configuration, if the toner cartridge 1 is not pressed to the right position, the front cover 220 cannot be closed, which can easily tell the user that the toner cartridge 1 is in a half-inserted state. Moreover, if there is provided a switch in linkage with the opening and closing of the front cover 220, it is possible to inhibit the operations of the machine itself, thereby preventing malfunction.

At the time of inserting the toner cartridge 1 into the image forming device 200, as shown in FIG. 4B, the toner cartridge 1 is inserted, in a state when the first inclined surface 121*a* is in parallel with the frame 222 of the image forming device 200 and the front rib 1225 is inclined, along the track 223 of the image forming device 200. If the toner cartridge 1 is viewed from the front, the first inclined surface 121*a* is angled with respect to the front rib 1225. At this time, the toner discharge port 112 is also in parallel with the frame 222. In the case where the first rib 1225 is inclined, the other ribs of the toner cartridge 1 are mounted in a state of overlapping the ribs of other toner cartridges 1, therefore, in the image forming device 200, it is possible to make the housing space of the toner cartridge 1 compact, to achieve miniaturization of the device. In addition, if a plurality of toner cartridges 1 are mounted in a manner of ribs overlapping as described above, the distance between the toner cartridges 1 becomes small, and the space between the toner cartridges 1 is substantially not occupied.

Figure 7:
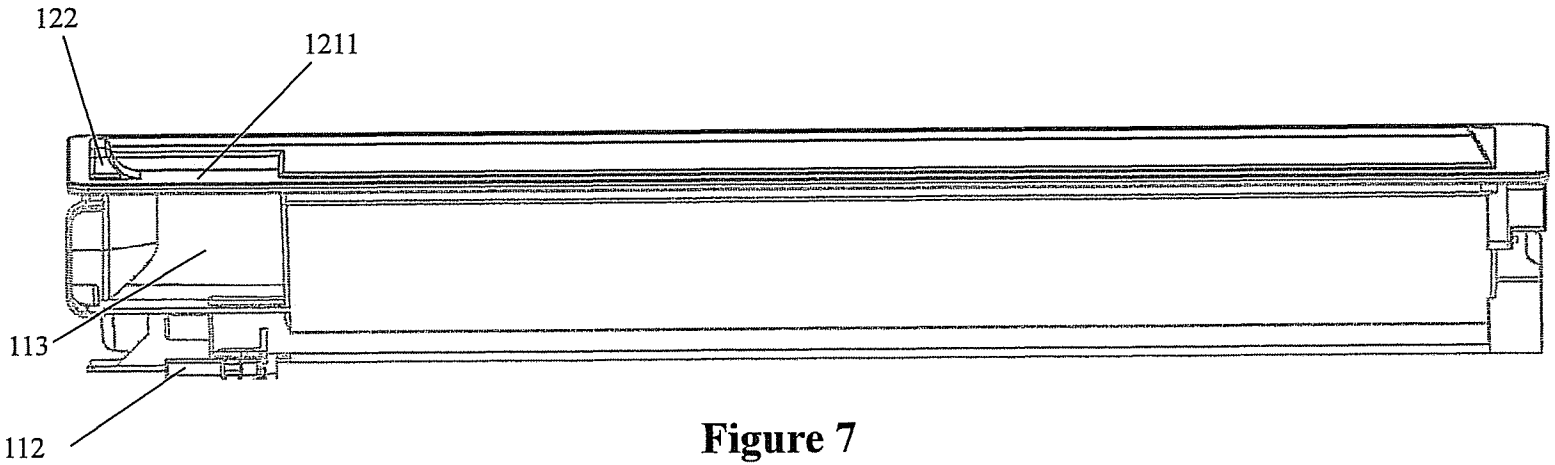
FIG. 7 is a side view of the toner cartridge 1 as viewed from a side.

FIG. 7 is a side view of the toner cartridge 1 as viewed from a side. In order to handle the toner cartridge 1, as shown in FIG. 7, on the right side surface of the toner cartridge 1, there is formed a concave portion 113 which is used as a handle. The user can put his hands on the concave portion 113, to mount/dismount the toner cartridge 1. Preferably, the wall surface of the concave portion 113 forms an angle of 89° with respect to the front rib 1225, i.e. almost perpendicular to the front rib 1225. In this way, it is easy to remove the toner cartridge 1 from the mold during manufacturing process.

As shown in FIG. 1, a cut 1211 is formed at a position of the second inclined surface 121*b* corresponding to the concave portion 113, specifically, at a position above the concave portion 113 used as a handle, in a state in which a part of the second inclined surface 121*b* is recessed. Preferably, the cut 1211 is planar. Compared with the practice of forming the cut 1211 as an incline, the practice of forming the cut 1211 as a plane can reduce residue of toner. That is, by forming a part of the second inclined surface 121*b* as a plane (the flat plate shape) as described above, it is possible to reduce residue of toner. At the time of inserting the toner cartridge 1 into the image forming device 200, the contact 201 is in contact with the inclined portion, and moves in the vicinity of the cut 1211 to a position above the projection 122.

Although in FIG. 4, only two toner cartridges are shown, in the case where the image forming device is a color compound machine, four toner cartridges can be parallel arranged.

The Second Embodiment

Hereinafter, another example of the top surface of the cover portion of the toner cartridge will be described with reference to the drawings.

Figure 8:
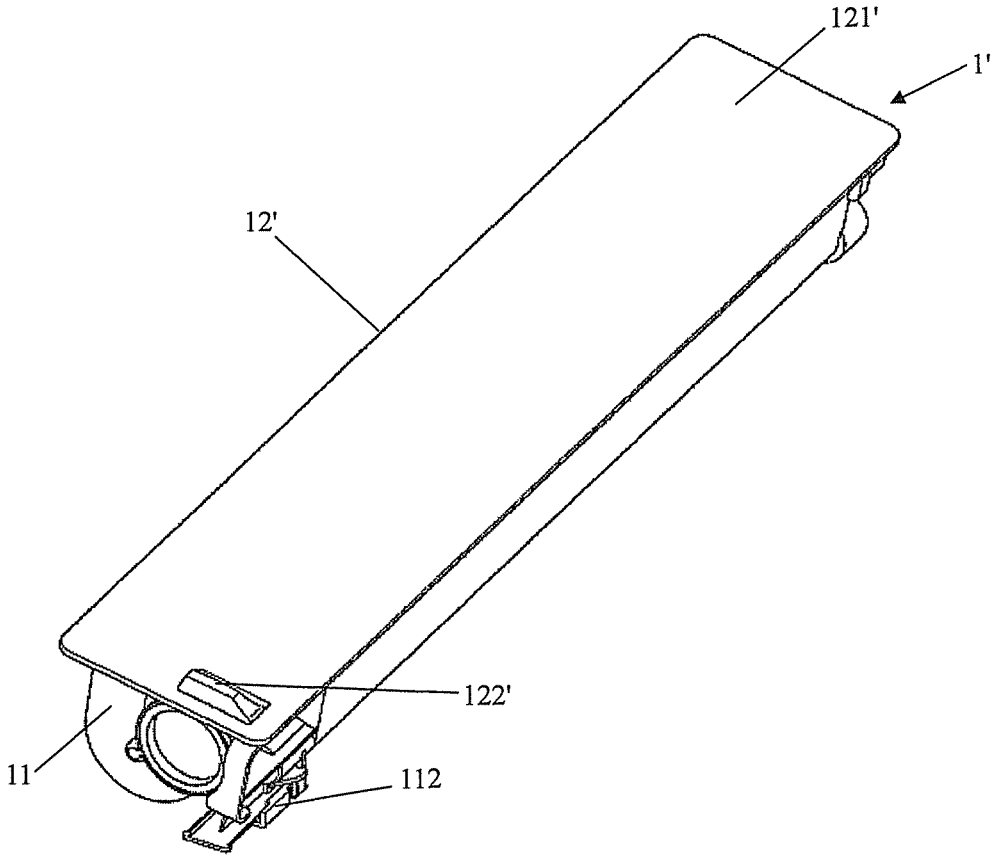
FIG. 8 is a stereogram of the toner container according to the second embodiment.

FIG. 8 is a stereogram view of the toner container according to the second embodiment.

As shown in FIG. 8, in the present embodiment, the top surface 121' of the cover portion 12' of the toner cartridge 1' is in a flat plate shape, instead of being formed to include two inclined surfaces as in the first embodiment. No cut 1211 is set on the top surface 121', and no ribs are formed around the top surface 121'.

Third Embodiment

A toner container according to a third embodiment is explained below with reference to the drawings. Reference numerals and signs same as those in the first embodiment denote the same components.

Figure 9:
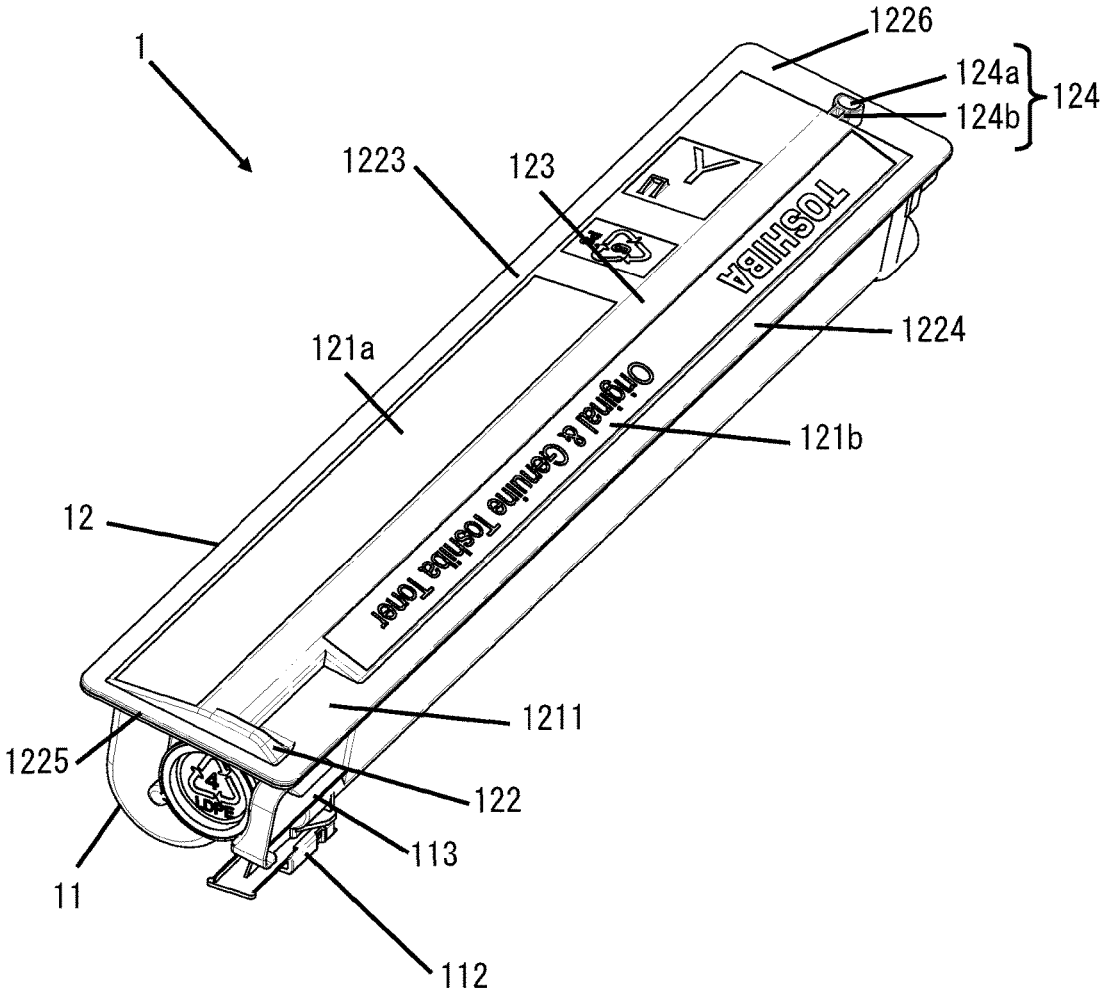
FIG. 9 is a perspective view of a toner container according to a third embodiment.

FIG. 9 is a perspective view of a toner container according to the third embodiment. As shown in FIG. 9, a toner cartridge 1, which is the toner container, includes a toner cartridge body including a toner chamber in which toner is stored and a toner discharge port 112 provided at one end portion of the toner chamber and a cover portion 12 that covers the toner cartridge body 11. The toner cartridge 1 supplies the toner to a not-shown developing device via the toner discharge port 112 arranged in the toner cartridge body 11.

A first rib 1223 and a second rib 1224 extending in the longitudinal direction are respectively provided on both the left and right sides of the cover portion 12. The first rib 1223 and the second rib 1224 functions as a track when the toner cartridge 1 is slid and inserted into an image forming device 200.

A front rib 1225 and a rear rib 1226 extending in the latitudinal direction are respectively provided on both the front and rear sides of the cover portion 12. A first inclined surface 121*a* and a second inclined surface 121*b* symmetrical to each other coupled to the ribs are provided on the top surface of the cover portion 12. The first inclined surface 121*a* extends in the front back direction (the longitudinal direction) of the toner cartridge 1 and inclines to be higher from the first rib 1223 toward a central portion 123 in the latitudinal direction of the top surface. The second inclined surface 121*b* extends in the front back direction (the longitudinal direction) of the toner cartridge 1 and inclines to be higher from the second rib 1224 toward the central portion 123 in the latitudinal direction of the top surface.

A projection 122 is provided at one end portion in the front back direction of the top surface of the cover portion 12. A surface at the other end portion of the projection 122 directed in the front back direction is an inclined portion 1221. As shown in FIG. 9, between the front rib 1225 and the first inclined surface 121*a* and between the front rib 1225 and the second inclined surface 121*b*, the projection 122 having a convex shape connected to the first inclined surface 121*a* and the second inclined surface 121*b* is provided in the direction vertical to the cover portion 12. Action and effects attained by providing the projection 122 are the same as those in the first embodiment. Therefore, explanation of the action and effects is omitted.

Figure 10:
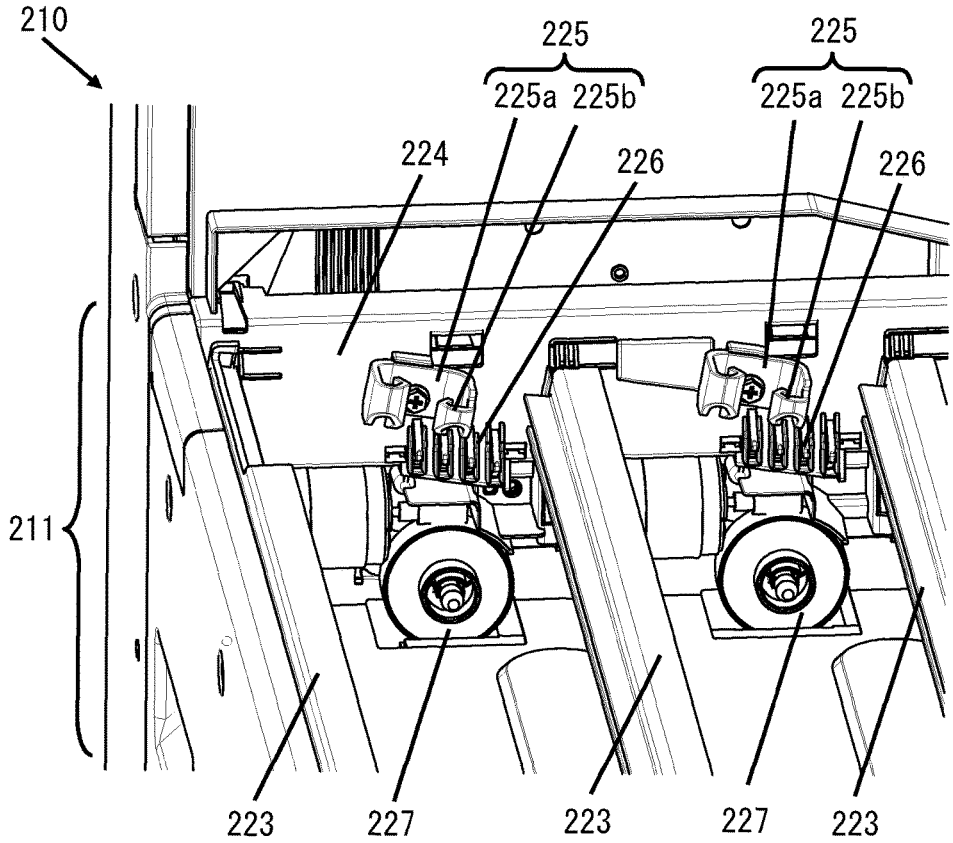
FIG. 10 is a perspective view of a body of an image forming device in a state in which a toner cartridge shown in FIG. 9 is not mounted in a toner driving unit.

Further, on the rear side of the toner cartridge 1, that is, near the rear end portion in the length direction of the toner cartridge 1, a projection 124 projecting along an inserting direction into a body 210 of the image forming device explained below is provided to correspond to an engaging member 225 provided on the side of the body 210 of the image forming device. The projection 124 on the rear side is hereinafter referred to as second projection to be distinguished from the projection (a first projection) 122 on the front side. The second projection 124 includes a distal portion 124*a* formed in a circular shape at the distal end side and a shaft portion 124*b* formed with a width smaller than the width of the distal portion 124*a* at the lower end of the distal portion 124*a*. The distal portion 124*a* is arranged such that the position of the distal end is present further on the front side of the toner cartridge 1 than the end portion of the rear rib 1226. The height of the top surface of the second projection 124 is preferably set to be lower than a highest place (the central portion 123) of the top surface of the toner cartridge 1. This is for the purpose of preventing contact with a not-shown ceiling portion of the body 210 of the image forming device during insertion of the toner cartridge 1. The shape of the distal portion 124*a* is not limited to the circular shape and may be other shapes such as an elliptical shape and a spherical shape. FIG. 10 is a perspective view of a toner driving unit 211 in a state in which the toner cartridge 1 shown in FIG. 9 is not mounted. The toner driving unit 211 is mounted with the toner cartridge 1 and applies driving force to a gear coupled to the toner driving unit 211 to discharge the toner from the toner discharge port 112. As shown in FIG. 10, in an upper part of an inner wall surface 224 of the toner driving unit 211, the engaging member 225 is arranged in a position facing the second projection 124 of the toner cartridge 1 inserted into the toner driving unit 211. The engaging member 225 is a member that is elastically deformed in a direction orthogonal to the length direction of the toner cartridge 1 according to force applied from the outside during a mounting action into the toner driving unit 211 and engages with the second projection 124 of the toner cartridge 1 to be insertable into and removable from the second projection 124.

The toner cartridge 1 according to this embodiment is different from the first embodiment in that the second projection 124 is formed on the rear side. The other components are the same as those in the first embodiment. Therefore, as shown in FIGS. 2 and 3, on the rear side of the toner cartridge 1, a coupling gear 114 that receives driving from a not-shown motor and a stirring gear 115 coupled to the coupling gear 114 are present. On the inside of the toner cartridge 1, an auger 116 that conveys the toner to the toner discharge port 112 and a mixer that agitates the toner are provided. The coupling gear 114 is coupled to the auger 116 and rotates the auger 116 and rotates the stirring gear 115. The stirring gear 115 rotates a not-shown mixer. In the vicinity (in FIG. 2, the upper left) of the stirring gear 115 of the toner cartridge 1, a storage medium such as an IC chip that records data such as an amount of use of the toner cartridge 1 and genuine product identification information is provided.

Therefore, as shown in FIG. 10, in the lower vicinity of the engaging member 225 on the inner wall surface 224, a reading portion 226 is provided. The reading portion 226 is arranged to correspond to the position of the storage medium of the toner cartridge 1 inserted along a track 223. The reading portion 226 comes into contact with the storage medium and reads the genuine product identification information and the like from the storage medium in a state in which the second projection 124 engages with the engaging member 225. Further, a coupling portion 227 that applies driving force to the coupling gear 114 of the toner cartridge 1 is provided below the reading portion 226.

Figure 11:
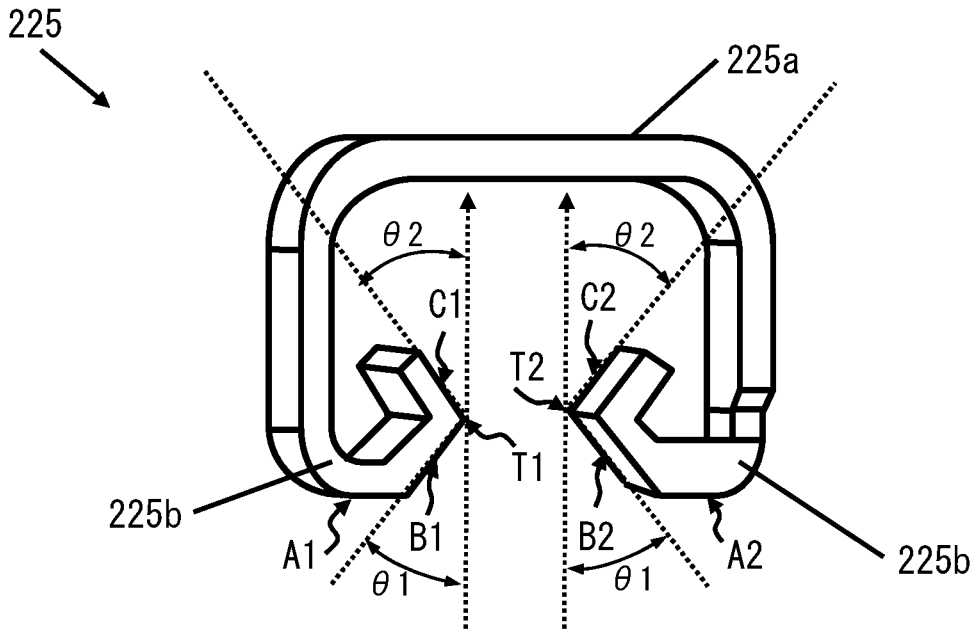
FIG. 11 is an enlarged view of an engaging member shown in FIG. 10.

FIG. 11 is an enlarged view of the engaging member 225 shown in FIG. 10. As shown in the figure, the engaging member 225 is divided into two regions, i.e., a U-shaped arm portion 225*a* and claw portions 225*b* that bend from both ends of the arm portion 225*a* toward the inner side and engage with the second projection 124 of the toner cartridge 1. The claw portion 225*b* includes a front surface A1 (A2) facing an end face on the rear side of the toner cartridge 1, an inclined portion B1 (B2) that inclines from an end portion of the front surface A1 (A2) to a center side of the arm portion 225*a* and comes into contact with the distal end of the second projection 124 first during insertion of the cartridge 1, and an inclined portion C1 (C2) that inclines from an end portion T1 (T2) of the inclined portion B1 (B2) in the both end direction of the arm portion 225*a* and comes into contact with the rear end portion of the second projection 124 at the completion of the insertion of the toner cartridge 1. Both of an inclination angle θ1 of the inclined portion B1 (B2) with respect to a broken line arrow representing the inserting direction of the toner cartridge 1 and an inclination angle θ2 of the inclined portion C1 (C2) with respect to the broken line arrow are about 40 to 45 degrees. However, if the engaging member 225 having different inclination angles of the inclined portions is used, it is possible to finely adjust force necessary during engagement and disengagement of the second projection 124 of the toner cartridge 1 and the claw portions 225*b* of the engaging member 225. The claw portions 225*b* of the engaging member 225 are formed to be bent. However, the engaging member 225 smoothly curled at the distal end portion may be used.

Figure 12:
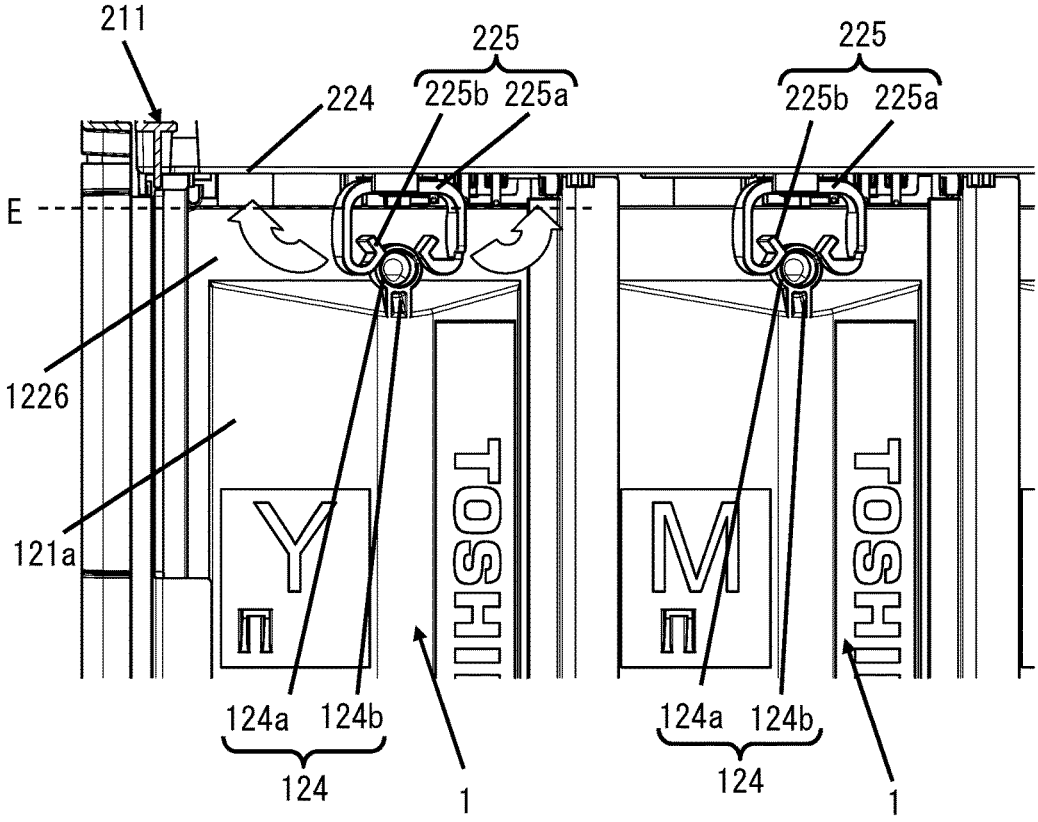
FIG. 12 is a top view of the toner driving unit in a state immediately before the toner cartridge shown in FIG. 9 is mounted in a regular position.
Figure 13:
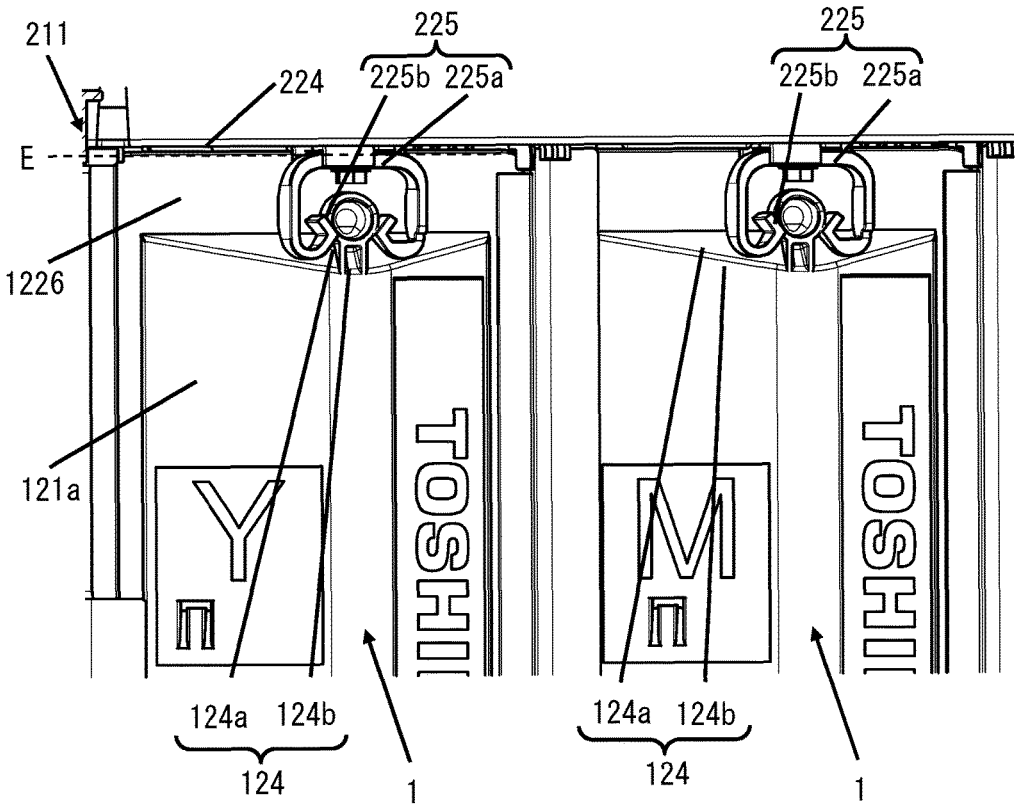
FIG. 13 is a top view of the toner driving unit in a state in which the toner cartridge shown in FIG. 9 is mounted in the regular position.

FIG. 12 is a top view of the toner driving unit 211 in a state immediately before the toner cartridge 1 is mounted in a regular position. On the other hand, FIG. 13 is a top view of the toner driving unit 211 in a state in which the toner cartridge 1 is mounted in the regular position. The second projection 124 is formed in a position and size for, in a state in which the distal portion 124*a* at the distal end is in contact with the claw portions 225*b* of the engaging member 225, separating the rear end portion in the longitudinal direction of the toner cartridge 1 from the inner wall surface 224 of the toner driving unit 211 and, in a state in which the distal portion 124*a* engages with the claw portions 225*b* of the engaging member 225, bringing the rear end portion of the toner cartridge 1 into contact with the inner wall surface 224.

In FIG. 12, the distal end portion of the second projection 124 on the top surface of the toner cartridge 1 is in contact with the distal end of the engaging member 225 on the side of the body 210 of the image forming device. As indicated by a broken line E, the position of the rear end portion in the longitudinal direction of the toner cartridge 1 (the end portion of the rear rib 1226) is separated from the inner wall surface 224 of the toner driving unit 211. At this point, a user can recognize that the toner cartridge 1 is approaching the regular mounting position.

When the toner cartridge 1 is further pushed in from the state shown in FIG. 12, force for expanding the engaging member 225 in an arrow direction is applied along the slopes of the claw portions 225*b* (the inclined portions B1 and B2 shown in FIG. 11). The second projection 124 climbs over the vertexes of the engaging member 225 (points T1 and T2 shown in FIG. 11) and is located on the inner side of the engaging member 225. During this period, the user can feel resistance force by the engaging member 225 via the toner cartridge 1. As shown in FIG. 13, the second projection 124 completely engages with the claw portions 225*b* of the engaging member 225. As indicated by a broken line E, the position of the rear end portion of the toner cartridge 1 reaches the inner wall surface 224. At this point, the user can feel, via the toner cartridge 1, vibration when the engaging member 225 locks the second projection 124. When the toner cartridge 1 is removed, the series of actions are reversed.

As explained above, with the toner container according to this embodiment, when the user inserts and removes the toner container, the user can feel a sense of click (resistance force and vibration). Therefore, the user can surely mount the toner container in the regular position. Further, when the toner container is mounted in the regular position, the storage medium of the toner container and the reading portion 226 of the body of the image forming device electrically come into contact with each other. Therefore, it is possible to read the genuine production identification information stored in the storage medium and surely distinguish whether the toner cartridge 1 is the genuine product.

In the embodiment, the second projection 124 is provided in the vicinity of the rear end of the top surface of the toner cartridge 1. However, the arrangement of the second projection 124 is not limited to this. The second projection 124 can be provided in a part of the surface of the cover portion 12 or the toner cartridge body (the toner chamber) 11. For example, the second projection 124 can also be provided on the side surface of the cover portion 12 or the toner cartridge body 11. In this case, by changing the arrangement of the engaging member 225 according to the second projection 124, it is possible to engage and disengage the second projection 124 and the engaging member 225 according to inserting and removing actions of the toner cartridge 1.

Although some embodiments have been illustrated and described herein, these embodiments are only given as examples without limiting the scope of the present embodiment. In fact, the new embodiments described herein may be embodied in various other forms. Furthermore, various omissions, substitutions and changes may be made to the embodiments without departing from the spirit of the present embodiment. The appended claims and their equivalents shall cover these methods or modifications, and fall within the scope and spirit of the present embodiment of the invention.

What is claimed is:

1. A toner container comprising:

a toner container body in which toner can be stored;

a cover portion on a first side of the toner container body and extending in a longitudinal direction between a first end and a second end of the toner container body; and a toner discharge port through which toner stored in the toner container body can be discharged, the toner discharge port being proximate to the first end of the toner container body, wherein the cover portion includes a first rib disposed along a first edge of the cover portion at the first end of toner container body, the first rib being in a first plane and extending in the longitudinal direction away from the toner container body, and the toner discharge port is inclined with respect to the first plane.

2. The toner container according to claim 1, further comprising:

a coupling member on the second end and configured to receive external driving.

3. The toner container according to claim 1, further comprising:

a projection proximate to the second end of the toner container body and projection from the cover portion in a direction away from the first side and extending in the longitudinal direction toward the second end.

4. The toner container according to claim 3, wherein the projection includes:

a first portion having a circular shape; and a second portion extending from the first portion along the longitudinal direction away from the second end, the second portion having a width along a width direction that is perpendicular to the longitudinal direction and parallel to the first plane that is less than a width of the first portion along the width direction.

5. The toner container according to claim 3, wherein the projection is insertable into and removable from an engaging member of an image forming device into which the toner container is insertable.

6. The toner container according to claim 1, further comprising:

a second rib disposed along a second edge of the cover portion at the second end of the toner container body, the second rib being parallel to the first plane and extending in the longitudinal direction away from the toner container body.

7. The toner container according to claim 6, further comprising:

a third rib disposed along a third edge of the cover portion along the longitudinal direction from the first end to the second end, the third rib being parallel to the first plane and extending away from the toner container body along a direction perpendicular to the longitudinal direction; and a fourth rib disposed along a fourth edge of the cover portion along the longitudinal direction from the first end to the second end, the fourth edge being opposite the third edge, the fourth rib being parallel to the first plane and extending away from the toner container body along the direction perpendicular to the longitudinal direction.

8. The toner container according to claim 6, further comprising:

a projection proximate to the second end of the toner container body and projection from the cover portion in a direction away from the first side and extending in the longitudinal direction toward the second end, wherein the projection does not extend beyond the second rib in the longitudinal direction.

9. The toner container according to claim 1, further comprising:

a storage medium in which identification information identifying the toner container is recorded, the storage medium being provided on the toner container body at a position proximate to the second end.

10. An image forming device comprising:

an image forming device body into which toner containers can be inserted in a predetermined orientation; and a toner container including:

a toner container body in which toner can be stored;

a cover portion on a first side of the toner container body and extending in a longitudinal direction between a first end and a second end of the toner container body; and a toner discharge port through which toner stored in the toner container body can be discharged, the toner discharge port being proximate to the first end of the toner container body, wherein the cover portion includes a first rib disposed along a first edge of the cover portion at the first end of toner container body, the first rib being in a first plane and extending in the longitudinal direction away from the toner container body, the toner discharge port is inclined with respect to the first plane, and the inclination between the first plane and the toner discharge port is such that the toner discharge port is substantially parallel to a first frame of the image forming device body in a second plane crossing the first plane.

11. The image forming device according to claim 10, wherein the toner container further comprises:

a coupling member on the second end and configured to receive external driving; and the image forming device body further comprises:

a toner driving unit configured to engage and drive the coupling member when the toner container is inserted in the predetermined orientation.

12. The image forming device according to claim 10, wherein the toner container further comprises:

a projection proximate to the second end of the toner container body and projection from the cover portion in a direction away from the first side and extending in the longitudinal direction toward the second end, and the image forming device body further comprises:

an engaging member arranged to be facing the projection when the toner container is inserted in the predetermined orientation, the engaging member being configured to be elastically deformed in a direction orthogonal to the longitudinal direction of the toner container body when the toner container is inserted in the image forming device body and the projection is engaged by the engaging member.

13. The image forming device according to claim 10, wherein the cover portion includes a first inclined surface portion on the first side of the toner container body, and the first inclined surface portion extends in a plane parallel to the second plane, and the first inclined surface portion faces the first frame when the toner container is inserted in the image forming device body in the predetermined direction.

14. The image forming device according to claim 10, wherein the toner container further comprises:

a second rib disposed along a second edge of the cover portion at the second end of the toner container body, the second rib being parallel to the first plane and extending in the longitudinal direction away from the toner container body, a third rib disposed along a third edge of the cover portion along the longitudinal direction from the first end to the second end, the third rib being parallel to the first plane and extending away from the toner container body along a direction perpendicular to the longitudinal direction, and a fourth rib disposed along a fourth edge of the cover portion along the longitudinal direction from the first end to the second end, the fourth edge being opposite the third edge, the fourth rib being parallel to the first plane and extending away from the toner container body along the direction perpendicular to the longitudinal direction; and the image forming device body further comprises:

a track engaging the third and fourth ribs when the toner container is inserted in the predetermined orientation.

15. The image forming device according to claim 10, wherein the cover portion of the toner container body includes:

a first inclined surface portion on the first side of the toner container body, the first inclined surface portion extending in a plane parallel to the second plane and facing the first frame when the toner container is inserted in the image forming device body in the predetermined direction; and a second inclined surface portion on the first side of the toner container body.

* * * * *